US008462055B2

(12) United States Patent
Jin et al.

(10) Patent No.: US 8,462,055 B2
(45) Date of Patent: Jun. 11, 2013

(54) PORTABLE TERMINAL

(75) Inventors: Young-Seok Jin, Gyeonggi-Do (KR); Chang-Il Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 470 days.

(21) Appl. No.: 12/781,025

(22) Filed: May 17, 2010

(65) Prior Publication Data

US 2011/0012795 A1 Jan. 20, 2011

(30) Foreign Application Priority Data

Jul. 20, 2009 (KR) ..... 10-2009-0066026

(51) Int. Cl.
*H01Q 1/24* (2006.01)

(52) U.S. Cl.
USPC ..... 343/702; 343/700 MS

(58) Field of Classification Search
USPC ..... 343/702, 700 MS
See application file for complete search history.

(56) References Cited

U.S. PATENT DOCUMENTS

| | | | | |
|---|---|---|---|---|
| 6,947,000 | B2 * | 9/2005 | Ito | 343/702 |
| 7,109,924 | B2 * | 9/2006 | Vance | 343/700 MS |
| 7,812,772 | B2 * | 10/2010 | Wen et al. | 343/702 |
| 2005/0219129 | A1 * | 10/2005 | Harano | 343/702 |
| 2008/0007468 | A1 * | 1/2008 | Sato et al. | 343/702 |
| 2010/0220016 | A1 * | 9/2010 | Nissinen et al. | 343/702 |

* cited by examiner

*Primary Examiner* — Hoanganh Le
(74) *Attorney, Agent, or Firm* — Birch, Stewart, Kolasch & Birch, LLP

(57) ABSTRACT

A portable terminal comprises: a terminal body having a receiver for sound output; a first antenna disposed in the terminal body, and operating at a first band; a second antenna disposed at a position different from the first antenna, and operating at a second band, wherein the second antenna comprises: a first conductor having a physical condition to be operable at the second band; and a second conductor having a physical condition to resonate an electromagnetic wave of the first band so as to reduce a field strength of the first band near the to receiver.

19 Claims, 15 Drawing Sheets

PORTABLE TERMINAL

CROSS-REFERENCE TO A RELATED APPLICATION

Pursuant to 35 U.S.C. §119(a), this application claims the benefit of earlier filing date and right of priority to Korean Application No. 10-2009-0066026, filed on Jul. 20, 2009, the content of which is incorporated by reference herein in its entirety.

BACKGROUND OF THE INVENTION

1. Field of the Invention

The present invention relates to a portable terminal, and more particularly, to a portable terminal having a structure to minimize interference with a hearing aid.

2. Background of the Invention

In general, a portable terminal serves as a portable device having one or more functions such as voice and video calls, information input/output, and data storage.

As the portable terminal now provides many additional services beside the basic call service, a user can capture photos or moving images, reproduce music or moving image files, play games, receive broadcasting programs, and so on. The portable terminal is implemented as a multimedia player.

Recently, concerns about influences of an electromagnetic wave generated from a portable terminal on a human's body are increasing. And, concerns about interference between a portable terminal and a hearing aid are also increasing. Due to this interference, an electromagnetic wave generated from the portable terminal may result in a mal-operation of the hearing aid.

Under these circumstances, the Federal Communications Commission (FCC) has legislated the Hearing Aid Compatibility (HAC) Act. The HAC Act is being applied to manufacturers for wireless devices such as hearing aids and portable terminals. And, this HAC Act is being widely used around the world.

The HAC Act serves to test and ensure compatibility between a wearer's hearing aid and a portable terminal without interference with each other. A magnetic field generated from the portable terminal is detected and amplified by a T-coil of the hearing aid, and a call sound is transmitted to the wearer. The HAC Act provides a measuring method and a regulation value with respect to a magnetic response of the hearing aid.

Hereinafter, a method for measuring a HAC rating will be explained. The method may include measuring a strength of an electric field generated from the periphery of a receiver 11 of the portable terminal.

Referring to FIG. 1, a receiver 11 is provided at one end of a terminal body 10 of the portable terminal. And, a measuring region 12 is provided so as to measure a strength of an electric field generated from a predetermined region centering around the receiver 11.

The measuring region 12 is formed in a size of 5 cm×5 cm at a height spacing from the terminal body 10 by 1 cm. As shown in FIG. 1, the measuring region 12 consists of nine grids 13. A field strength of each grid 13 is measured by a probe used to measure an electric field. From eight grids 13 excluding the center grid 14, three grids having relatively high field strengths of electromagnetic waves are excluded. Then, a highest field strength of electromagnetic waves measured with respect to the center grid 14 and the rest five grids 13 serves as a peak value to determine a HAC rating. This peak value is required to be less than a predetermined value.

Accordingly, research is actively ongoing so as to reduce a field strength near the receiver 11 when designing and manufacturing portable terminals.

SUMMARY OF THE INVENTION

Therefore, an object of the present invention is to provide a portable terminal capable of minimizing interference with a hearing aid by reducing a strength of an electric field generated near a receiver of the portable terminal.

To achieve these and other advantages and in accordance with the purpose of the present invention, as embodied and broadly described herein, there is provided a portable terminal, comprising: a terminal body having a receiver for sound output; a first antenna disposed in the terminal body, and operating at a first band; a second antenna disposed at a position different from the first antenna, and operating at a second band, wherein the second antenna comprises: a first conductor having a physical condition operable at the second band; and a second conductor having a physical condition to resonate an electromagnetic wave of the first band so as to reduce a field strength of the first band near the receiver.

The receiver may be disposed at one end of the terminal body, and the first antenna may be disposed at another end of the terminal body.

The second antenna may be disposed at one end of the terminal body, or may be extending from the first antenna in one direction. And, the second antenna may be disposed at a position spacing from the first antenna in a length direction of the terminal body.

The second conductor may be extendingly-formed from the first conductor.

The first antenna may be configured to be operable at a plurality of bands, and the first band may indicate a band which forms a highest field strength near the receiver among the plurality of bands.

At a part of the first antenna, may be formed a radiating region for radiating an electromagnetic wave from the first band. And, the second antenna may be disposed at a position corresponding to the radiating region in a width direction of the terminal body.

The second antenna may be disposed at one side of the receiver. In this case, a third antenna operating at a third band may be additionally disposed at another side of the receiver.

According to another aspect of the present invention, there is provided a portable terminal, comprising: a terminal body; a receiver disposed at one end of the terminal body, and configured to output a sound; a first antenna disposed at another end of the terminal body, and operating at a first band; a second antenna disposed at a position different from the first antenna, and operating at a second band, wherein the second antenna comprises: a first conductor having a physical condition operable at the second band; and a second conductor having a physical condition to resonate an electromagnetic wave of the first band so as to reduce a field strength of the first band near the receiver.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, a portable terminal according to preferred embodiments of the present invention will be explained in more detail with reference to the attached drawings.

Figure 2:
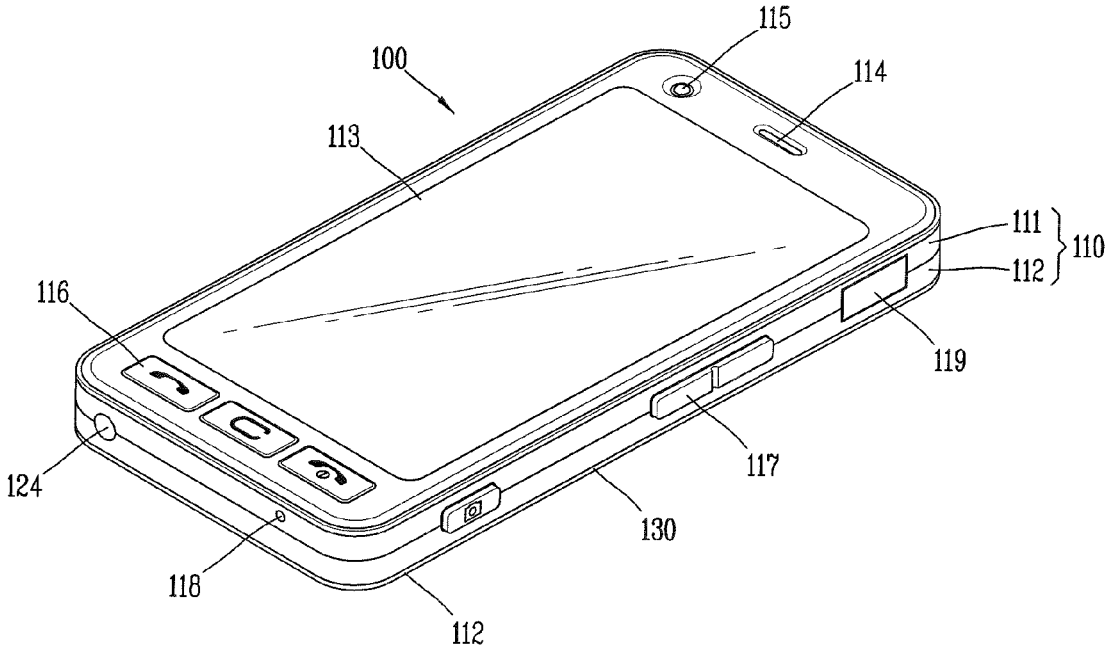
FIG. 2 is a front perspective view of a portable terminal according to a first embodiment of the present invention.

FIG. 2 is a front perspective view of a portable terminal 100 according to a first embodiment of the present invention.

The portable terminal 100 according to the present invention comprises a terminal body 110 which forms an outer appearance of the portable terminal 100.

A case (casing, housing, cover, etc.) forming an outer appearance of the terminal body 110 may include a front case 111 and a rear case 112. A space formed by the front case 111 and the rear case 112 may accommodate various components therein. At least one intermediate case 111*a* may further be disposed between the front case 111 and the rear case 112.

Such cases may be formed by injection-molded synthetic resin, or may be formed using a metallic material such as stainless steel (STS) or titanium (Ti).

At the terminal body 110, may be disposed a display unit 113, a first audio output unit 115, first and second manipulation units 116, 117, an audio input unit 118, an interface 119, etc.

The display unit 113 includes a liquid crystal display (LCD) module, an organic light radiating diodes (OLED) module, etc. for visually displaying information.

The display unit 113 may further include a touch screen for inputting information by a user's touch. The display unit 113 may display visual information such as numbers, texts, and symbols so that phone numbers, etc. can be inputted. A user may input information by touching the visual information displayed on the display unit 113.

The first audio output unit 114 may be implemented as a receiver or a speaker. The first audio output unit 114 is disposed at one end of the terminal body 110 so as to be positioned at a user's ear.

A first image input unit 115 may be implemented as a camera module for capturing a still image or a moving image of a user, etc.

The first and second manipulation units 116, 117 receive commands for controlling the operation of the portable terminal 100. The first and second manipulation units 116, 117 may be referred to as a manipulating portion. Such manipulating portion can employ any tactile manner that a user can touch or tap for manipulation.

The manipulation units may be implemented as dome switches or touch pads to receive information input in a user's push or touch manner, or may be implemented as jog wheels, jog sticks, and the like.

In the aspect of functions, the first manipulation unit 116 may serve to input various commands such as start, stop, and scroll commands. And, the second manipulation unit 117 may be configured to have a function to control a level of sound outputted from the first audio output unit 114, a function to activate/deactivate a touch recognition mode of the display unit 113, etc.

The audio input unit 118 configured to receive a user's voice, other sounds, etc. may be implemented as a microphone.

The interface 119 may serve as a passage through which the portable terminal 100 of the present invention can exchange data with external devices. The interface 119 may be implemented by wire or by radio, and may include one of an access port to an earphone, a short-range communication port (e.g., IrDA port, Bluetooth port, wireless LAN port, and the like), and a power supply port for supplying power to the portable terminal.

Figure 3:
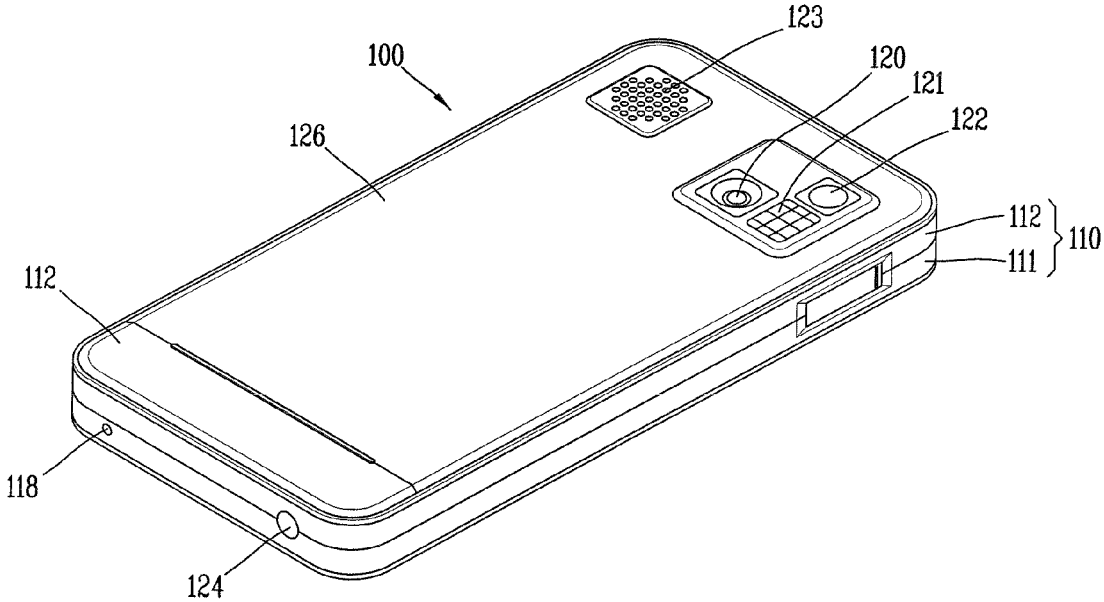
FIG. 3 is a rear perspective view of the portable terminal according to a first embodiment of the present invention.

The interface 119 may be a card socket for receiving an external card such as a subscriber identification module (SIM), a User Identification Module (UIM), and a memory card for storing information FIG. 3 is a rear perspective view of the portable terminal of FIG. 2.

Figure 1:
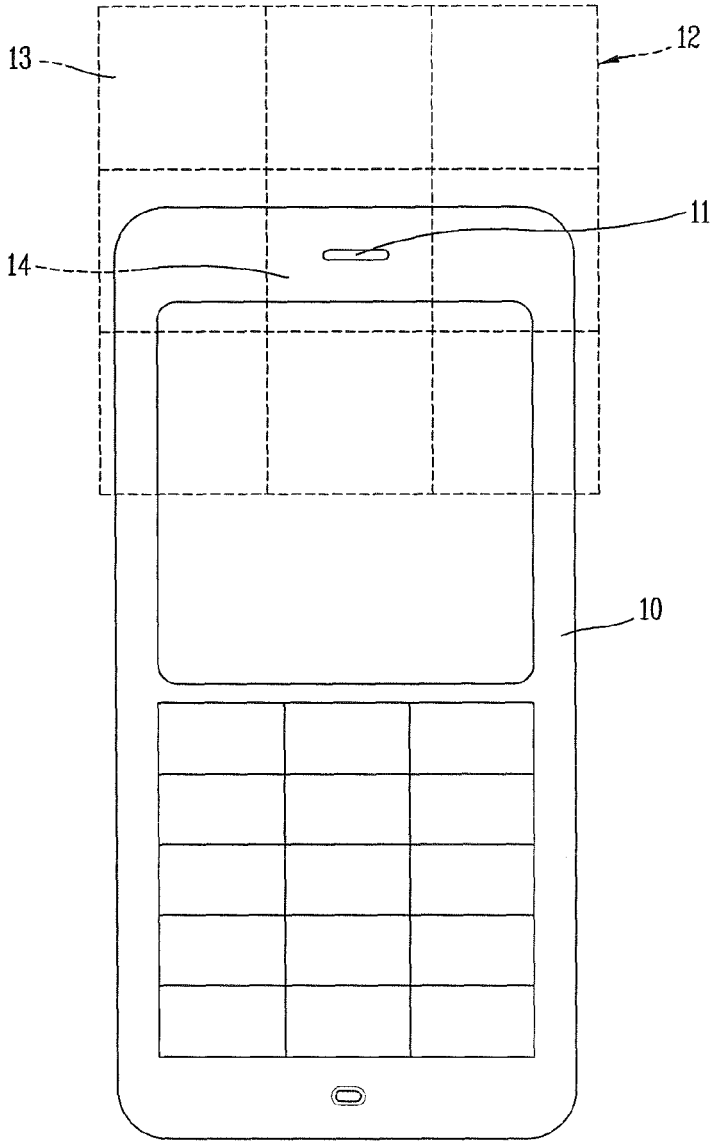
FIG. 1 is a view showing a method for measuring a field strength near a portable terminal, the method regulated in a Hearing Aid Compatibility (HAC) Act.

Referring to FIG. 3, an image input unit 120 may be additionally provided on a rear surface of the terminal body 110. The second image input unit 120 faces a direction which is opposite to a direction faced by the first image input unit 115 (refer to FIG. 1), and may have different pixels from those of the first image input unit 115.

For example, the first image input unit 115 may operate with relatively lower pixels (lower resolution). Thus, the first image input unit 115 may be useful when a user can capture his face and send it to another party during a video call or the like. On the other hand, the second image input unit 120 may operate with a relatively higher pixels (higher resolution) such that it can be useful for a user to obtain higher quality pictures for later use.

A flash 121 and a mirror 122 may be additionally disposed adjacent to the second image input unit 120. The flash 121 operates in conjunction with the second image input unit 120 when taking a picture using the second image input unit 120. The mirror 122 can cooperate with the second image input unit 120 to allow a user to photograph himself in a self-portrait mode.

A second audio output unit 123 may be further disposed on a rear surface of the terminal body 110. The second audio output unit 123 can cooperate with the first audio output unit 114 (refer to FIG. 1) to implement a stereo function. Also, the second audio output unit 123 may be configured to operate as a speakerphone.

A power supply unit 125 (refer to FIG. 8) for supplying power to the portable terminal 100 may be mounted in the rear case 112. The power supply unit 125 may be implemented as a rechargeable battery as shown in the preferred embodiment. A battery cover 126 for covering the battery 125 is detachably mounted to the rear case 112.

A broadcast signal receiving antenna 124 may be disposed at one side of the terminal body 110, in addition to an antenna for communications. The broadcast signal receiving antenna 124 may be configured to retract into the terminal body 110.

Figure 4:
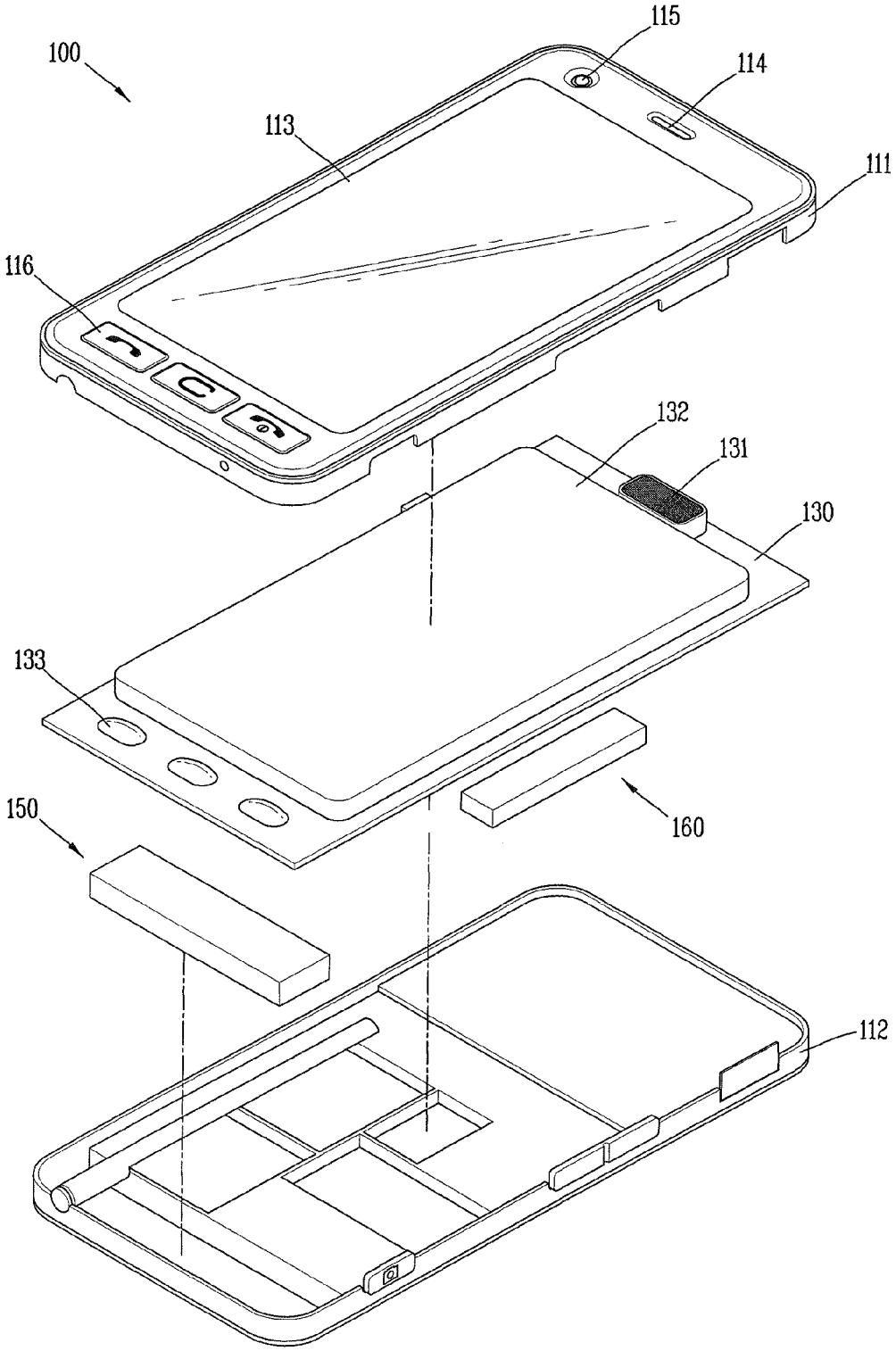
FIG. 4 is an exploded perspective view of the portable terminal of FIGS. 2 and 3.

FIG. 4 is an exploded perspective view of the portable terminal of FIGS. 2 and 3.

A printed circuit board (PCB) 130 is mounted between the front case 111 and the rear case 112. Electronic components for operating each function of the portable terminal 100 are mounted on the PCB 130.

A receiver 131 configured to implement the audio output unit 114 is mounted to one end of the terminal body 110. The receiver 131 may be mounted near an end portion of the PCB 130.

A display module 132 configured to output visual information is mounted below the receiver 131. Below the display module 132, may be mounted switches 133 configured to generate signals as the first manipulation unit 116 is pressed.

A first antenna 150 operating at a first band is mounted to one side (one surface) of the PCB 130. And, a second antenna 160 operating at a second band is disposed at a position different from the first antenna 150.

In the preferred embodiment, the first antenna 150 is mounted to another end of the terminal body 110, i.e., the end portion opposite to the receiver 130. And, the second antenna 160 is mounted to a side surface of the terminal body 110, and is spacing from the first antenna 150 by a predetermined distance.

Figure 5:
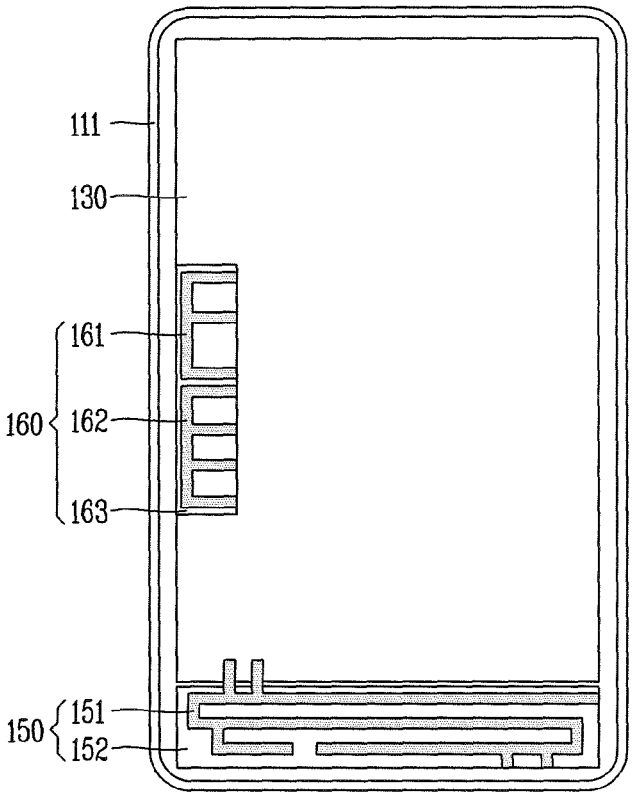
FIG. 5 is a rear view of a printed circuit board (PCB) of the portable terminal according to a first embodiment of the present invention.

FIG. 5 is a rear view of the PCB of the portable terminal of FIG. 4.

Referring to FIG. 5, the first antenna 150 may include a radiator 151 formed of a conductive material, a carrier 152 configured to mount and support the radiator 151, etc.

The radiator 151 serves to radiate an electromagnetic wave, and is configured to be fed by the PCB 130. The radiator 151 has a physical condition that the conductive material can radiate an electromagnetic wave of a first band. For instance, the radiator 151 may have a length such as a half wavelength and a quarter wavelength of the first band so as to resonate an electromagnetic wave of the first band. And, the radiator 151 may be patterned on the carrier 152 with any shape so as to obtain the length.

The carrier 152 may be formed to have any shape corresponding to an inner space of the case, so as to be mounted in the case of the portable terminal, e.g., the front and rear cases. And, the carrier 152 may be fixed to the case or the PCB 130 so as to maintain a stable fixed state.

The second antenna 160 includes a first conductor 161, a second conductor 162, and a carrier 163.

The first conductor 161 has a physical condition operable at a second band, and is configured to be fed by the PCB 130. The first conductor 161 may have a length such as a half wavelength and a quarter wavelength of the second band so as to resonate an electromagnetic wave of the second band. The first conductor 161 has the same function as the radiator 151 of the first antenna 150.

The second conductor 162 has a physical condition to resonate an electromagnetic wave of the first band. The second conductor 162 does not radiate an electromagnetic wave of the first band, but reduces a field strength of the first band near the receiver 131 by being wirelessly coupled to the radiator 151 of the first antenna 150.

The first conductor 161 and the second conductor 162 may be patterned on the carrier 163 with any shapes. For instance, the second conductor 162 may have a length such as a half wavelength and a quarter wavelength of the first band, and may be patterned at one side of the first conductor 161 with any shape. The second conductor 162 may be formed to be connected to or separated from the first conductor 161.

Figure 6A:
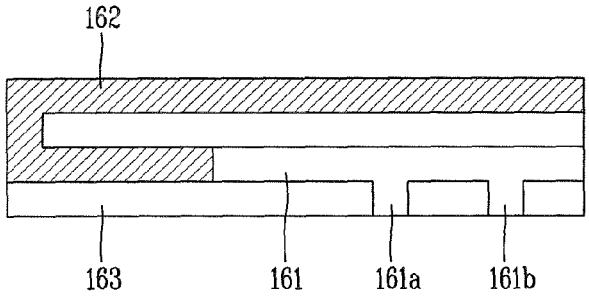
FIGS. 6A to 6C are rear views of a second antenna, which show a plurality of types of first and second conductors.
Figure 6B:
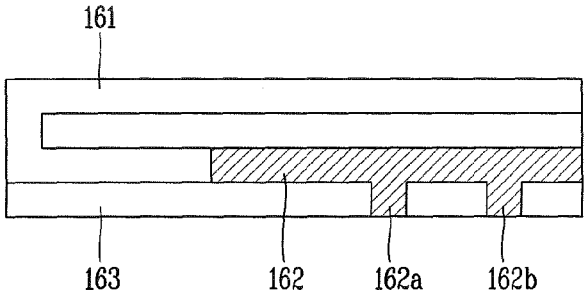
Figure 6C:
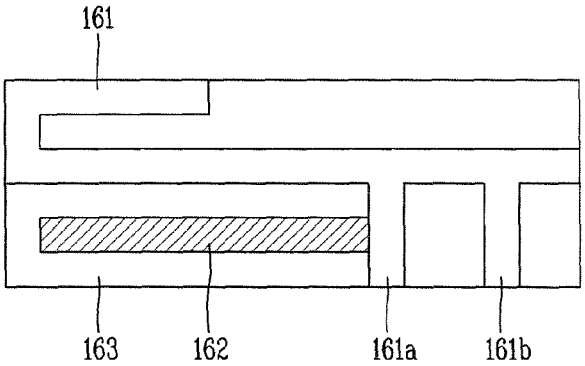

FIGS. 6A to 6C are rear views of the second antenna, which show a plurality of types of the first and second conductors. In FIGS. 6A to 6C, the second conductor 162 is indicated by a dotted line.

As shown in FIG. 6A, the second conductor 162 may be extendingly formed from the first conductor 161. In FIG. 6A, the second conductor 162 is extending from an end portion of the first conductor 161. Here, the second conductor 162 may be extending from a middle part of the first conductor 161.

The first conductor 161 may include a feeding portion 161 a for feeding the second antenna 160, and a grounding portion 161*b* for grounding the second antenna 160. The feeding portion 161*a* and the grounding portion 161*b* are connected to a feeding terminal and a grounding terminal of the PCB 130, respectively.

As shown in FIG. 6B, a feeding portion 162*a* and a grounding portion 162*b* may be formed at the second conductor 162. In FIG. 6B, the first conductor 161 is extending from an end portion of the second conductor 162.

Referring to FIG. 6C, the feeding portion 161*a* and the grounding portion 161*b* are formed at the first conductor 161. In this case, the second conductor 162 may be extending from the feeding portion 161*a*. On the other hand, the feeding portion 161*a* and the grounding portion 161*b* may be formed at the second conductor 162. In this case, the first conductor 161 may be extending from the feeding portion 161*a*.

In the following FIGS, the first and second conductors are indicated by dotted lines, and may have the same configurations as the aforementioned ones.

Figure 7:
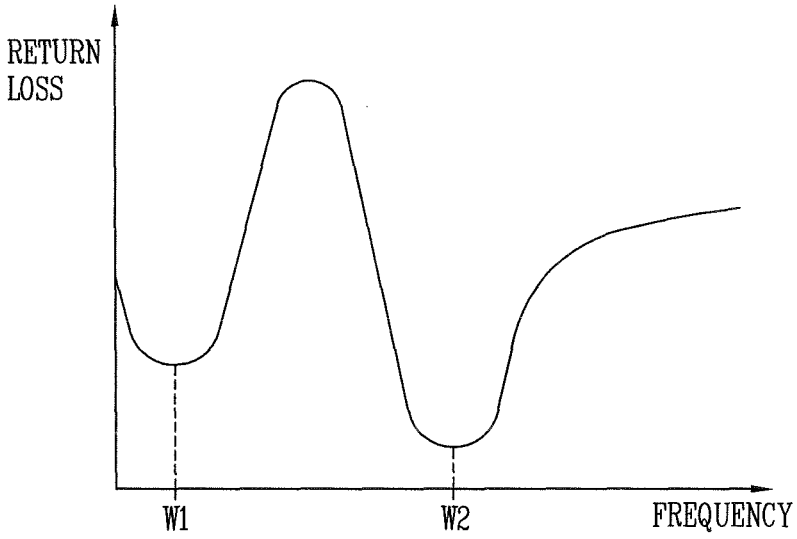
FIG. 7 is a graph showing a Voltage Standing Wave Ratio (VSWR) of the second antenna.

FIG. 7 is a graph showing a Voltage Standing Wave Ratio (VSWR) of the second antenna. Here, the VSWR denotes a ratio between a minimum value and a maximum value of a sine wave, and the sine wave is a criteria representing a size of the VSWR.

Referring to FIG. 7, a resonance may additionally occur at a first band (W1) as well as at a second band (W2) of the second antenna 160.

The second antenna 160 is configured to resonate an electromagnetic wave of the second band (W2) by the first conductor 161. Accordingly, the second antenna 160 operates at the second band (W2). And, the second antenna 160 is configured to further resonate an electromagnetic wave of the first band (W1) by the second conductor 162.

Under these configurations, a field strength of an electromagnetic wave of the first band (W1) near the receiver 131 may be reduced. This may minimize interference between the portable terminal and a hearing aid.

In the preferred embodiment, the first antenna 150 is implemented as a main antenna for a voice communication and a wireless data communication, whereas the second antenna 160 is implemented as a sub-antenna for a short-range communication or a GPS communication using BLUETOOTH.

In this case, the first band (W1) of the first antenna 150 may include one of GSM/WCDMA 850 Mhz, GSM/WCDMA 900 Mhz, DCS/GSM 1800 Mhz, PCS/GSM 1900 Mhz, and WCDMA 2100 Mhz. And, the second band (W2) of the second antenna 160 may include Bluetooth 2400 Mhz or GPS 1500 Mhz. Since the first antenna 150 is mainly used to perform a voice communication and a data communication, it may be referred to as a 'main antenna'. Accordingly, the second antenna 160 may be referred to as a 'sub-antenna'.

Figure 8:
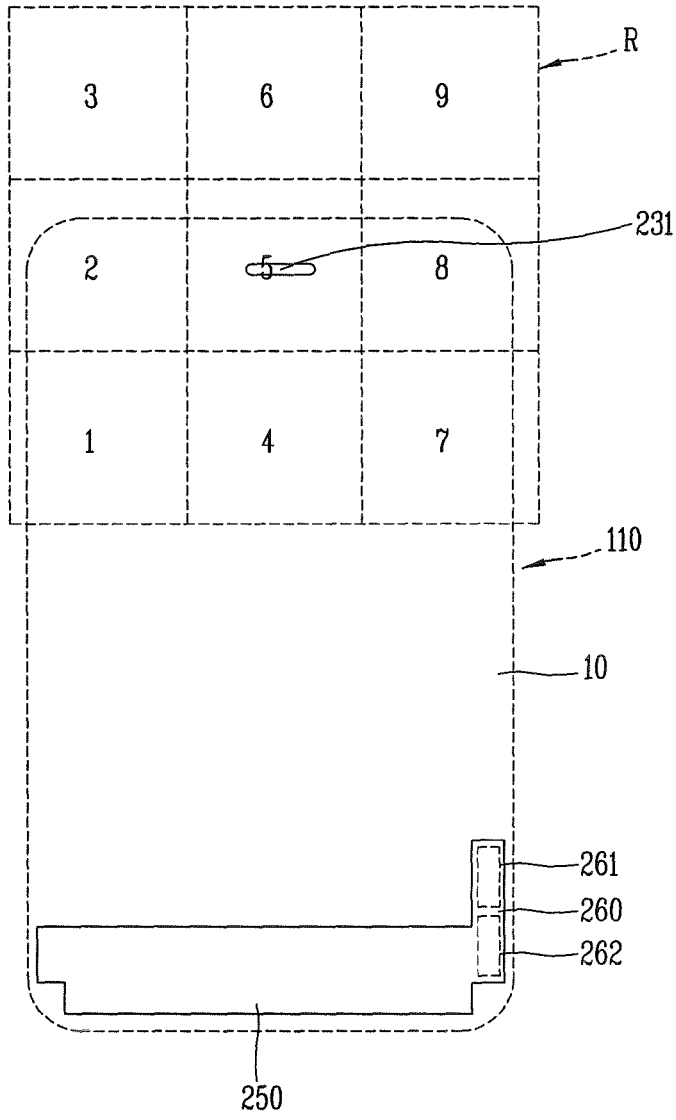
FIG. 8 is a schematic front view of a portable terminal according to a second embodiment of the present invention.

FIG. 8 is a schematic front view of a portable terminal according to a second embodiment of the present invention. The same or similar reference numerals as/to those of the first embodiment are given to the same or similar components as/to those of the first embodiment.

As aforementioned, a receiver 231 is disposed at one end of a terminal body 210, and a first antenna 250 is disposed at another end of the terminal body 210. For convenience, Nos. 1~9 were given to respective parts of a measuring region (R).

In the second embodiment, a second antenna 260 is extending from the first antenna 250 in one direction. In FIG. 8, the second antenna 260 is extending from a lateral end of the first antenna 250 in a length direction of the terminal body 210.

Like in the first embodiment, the second antenna 260 includes: a first conductor 261 having a physical condition operable at a second band, and a second conductor 262 having a physical condition to resonate an electromagnetic wave of a first band.

The first and second conductors 261, 262 may be mounted on a carrier of the first antenna 250. That is, the carrier of the first antenna 250 may have an extension portion extending in one direction, and the first and second conductors 261, 262 may be formed on the extension portion.

Figure 9A:
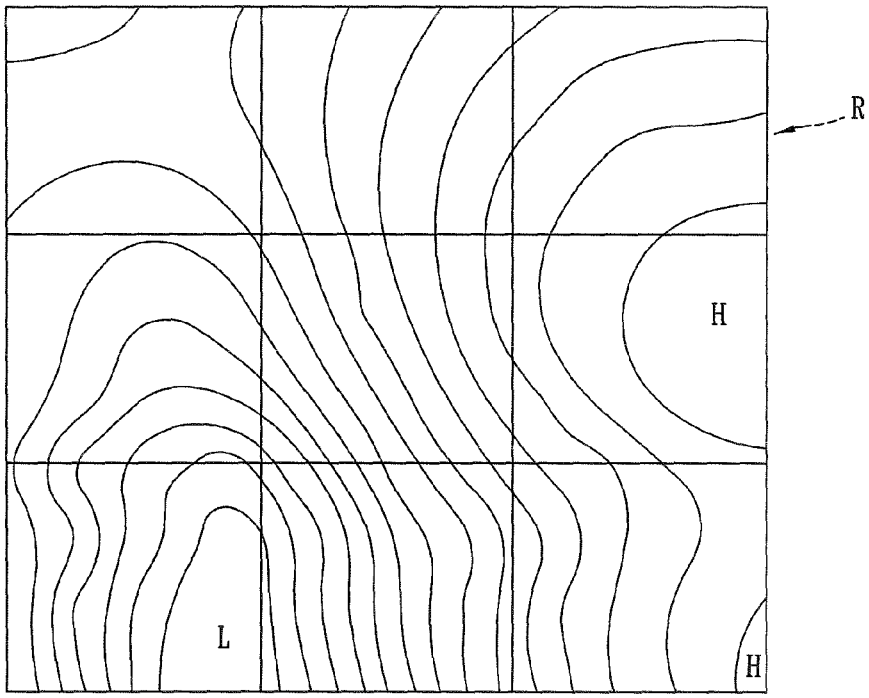
FIGS. 9A and 9B show distributions of electric fields before and after the second conductor of FIG. 8 is applied to the second antenna.
Figure 9B:
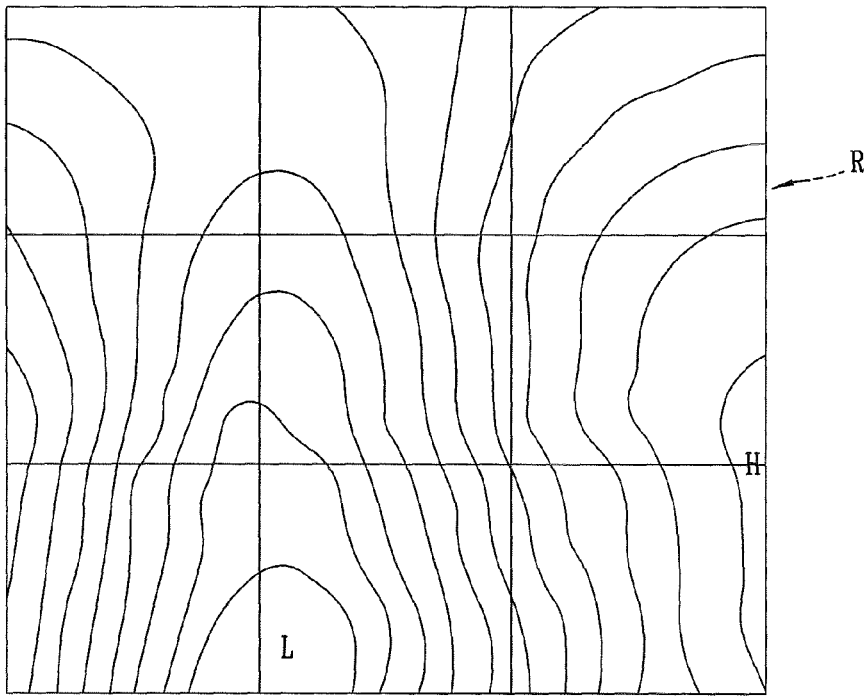

FIGS. 9A and 9B show distributions of electric fields before and after the second conductor of FIG. 8 is applied to the second antenna. In FIGS. 9A and 9B, "H" indicates a high field strength, and "L" indicates a low field strength.

Referring to FIG. 9A, before the second conductor 262 is applied to the second antenna 260, a high electric field is distributed to the right side of the measuring region (R), i.e., regions of 7~9.

Referring to FIG. 9B, when the second conductor 262 is applied to the second antenna 260, a high electric field having been distributed to the right side of the measuring region (R), i.e., regions of 7~9 is weakened. That is, it can be seen that the high electric field of FIG. 9 is shifted to the right side as the second conductor 261 is applied to the second antenna 260.

Accordingly, it can be seen that the field strength of the measuring region (R) is reduced as the second conductor 262 is applied to the second antenna 260.

Figure 10:
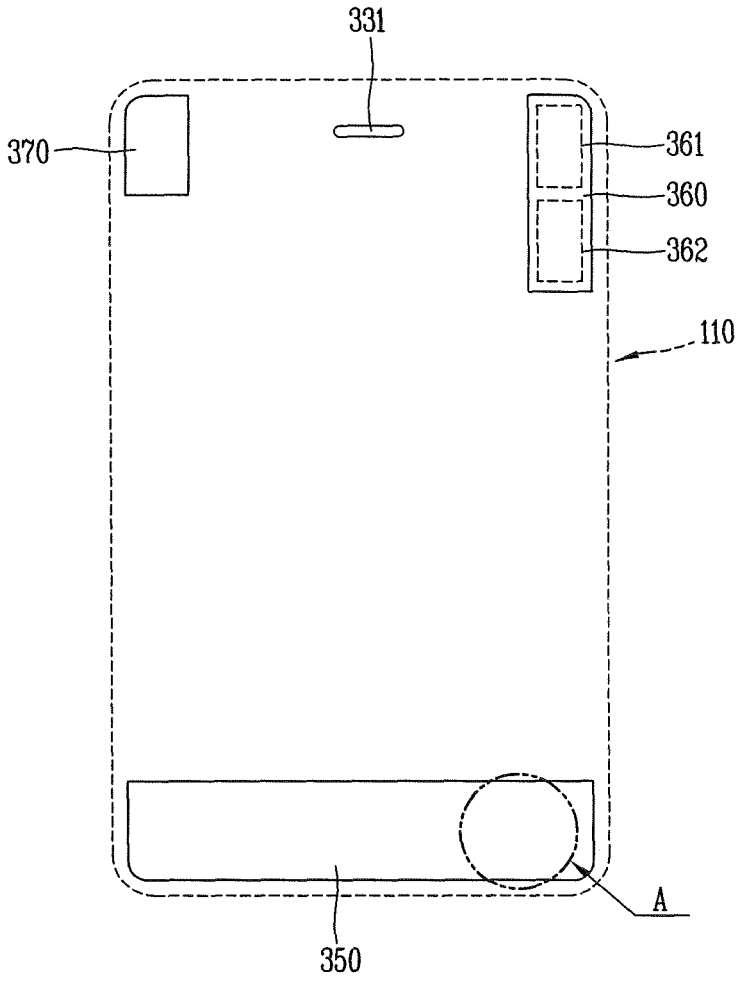
FIG. 10 is a schematic front view of a portable terminal according to a third embodiment of the present invention.
Figure 11:
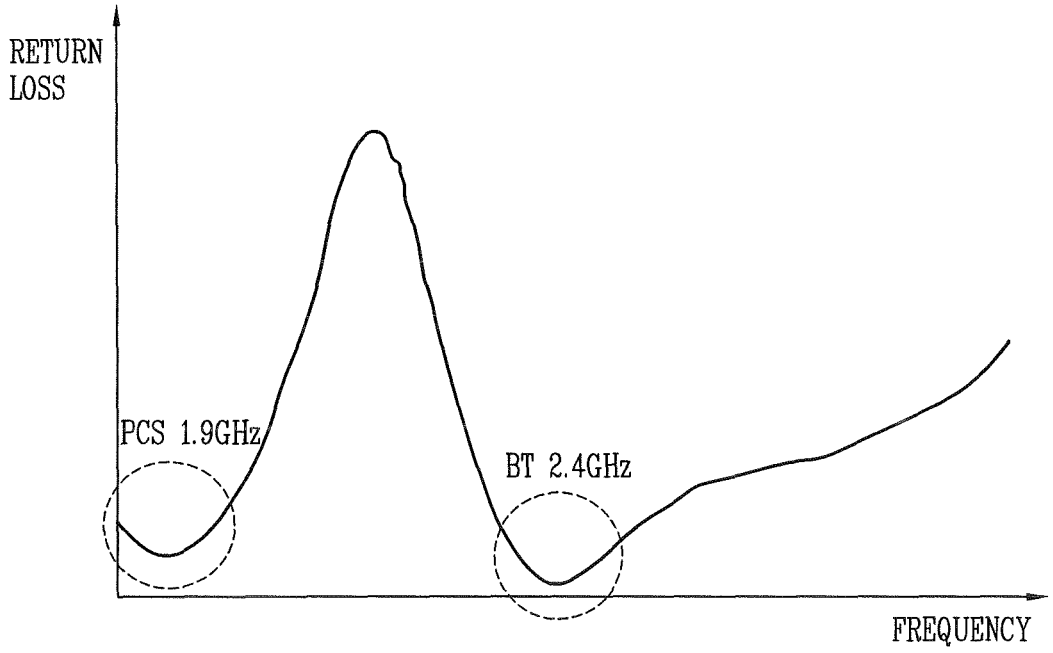
FIG. 11 is a graph showing a VSWR of the second antenna of FIG. 10.

FIG. 10 is a schematic front view of a portable terminal according to a third embodiment of the present invention, and FIG. 11 is a graph showing a voltage stranding wave ratio (VSWR) of the second antenna of FIG. 10.

Referring to FIG. 10, a receiver 331 is disposed at one end of a terminal body 310, and a first antenna 350 is disposed at another end of the terminal body 310.

In the third embodiment, a second antenna 360 is disposed at a position spacing from the first antenna 350 by a predetermined distance in a length direction of the terminal body 310. For instance, the second antenna 360 may be disposed at one side of the receiver 331.

The portable terminal according to the third embodiment may further comprise a third antenna 370 operating at a third band. The third antenna 370 may be also disposed at a position spacing from the first antenna 350 by a predetermined distance in a length direction of the terminal body 310. For instance, the third antenna 370 may be disposed at another side of the receiver 331.

The first antenna 350 is configured to be operable at a plurality of bands. For instance, the first antenna 350 may be configured to be operable at two or more bands among GSM/WCDMA 850 Mhz, GSM/WCDMA 900 Mhz, DCS/GSM 1800 Mhz, PCS/GSM 1900 Mhz, and WCDMA 2100 Mhz bands.

In the third embodiment, the first antenna 350 is implemented as a main antenna operable at four bands of GSM 850 Mhz, GSM 900 Mhz, DCS 1800 Mhz, PCS 1900 Mhz.

The second antenna 360 and the third antenna 370 are implemented as sub antennas for a BLUETOOTH communication or a GPS communication. In the third embodiment, the second antenna 360 is implemented as a BLUETOOTH antenna, whereas the third antenna 370 is implemented as a GPS antenna. The second antenna 360 has BLUETOOTH 2400 MHz (second band) as an operation band, and the third antenna 370 has GPS 1500 MHz (third band) as an operation band.

Here, the first band may indicate a band which forms a maximum field strength near the receiver 331 among a plurality of bands. The field strength of the measuring region may be relatively weakened by weakening the maximum field strength formed by the first band with using a second conductor 362 of the second antenna 360.

In the third embodiment, the maximum field strength is formed by an electromagnetic wave of PCS 1900 Mhz (first band). Accordingly, the second conductor 362 of the second antenna 360 may be configured to have a physical condition to resonate an electromagnetic wave of PCS 1900 Mhz band.

An electromagnetic wave of PCS 1900 Mhz band (first band) is radiated from the first antenna 350. Among a plurality of bands, a region where an electromagnetic wave of a first band which forms a maximum field strength is radiated will be referred to as a 'radiating region'. In the third embodiment, the radiating region (A) is formed at the right side of the first antenna 350.

Here, the second antenna 360 may be disposed at a position corresponding to the radiating region (A) in a width direction of the terminal body 310. In a case that the radiating region (A) is formed at the right side based on a central region of the terminal body 310, the second antenna 360 may be also disposed at the right side based on the central region of the terminal body 310.

That is the second antenna 360 is disposed at the right side of the receiver 331, whereas the third antenna 370 is disposed at the left side of the receiver 331.

A first conductor 361 and a second conductor 362 may be formed on a rear surface of the second antenna 360. By corresponding the radiating region (A) of the first antenna 350 to the position of the second conductor 362, may be facilitated coupling between the first antenna 350 and the second conductor 362.

In the third embodiment, both the second antenna 360 and the third antenna 370 are applied. However, the second antenna 360 may be exclusively applied without using the third antenna 370.

Referring to FIG. 11, the second antenna 360 may be configured to further resonate at PCS 1900 Mhz band (first band), as well as at BLUETOOTH 2400 Mhz (second band).

Figure 12A:
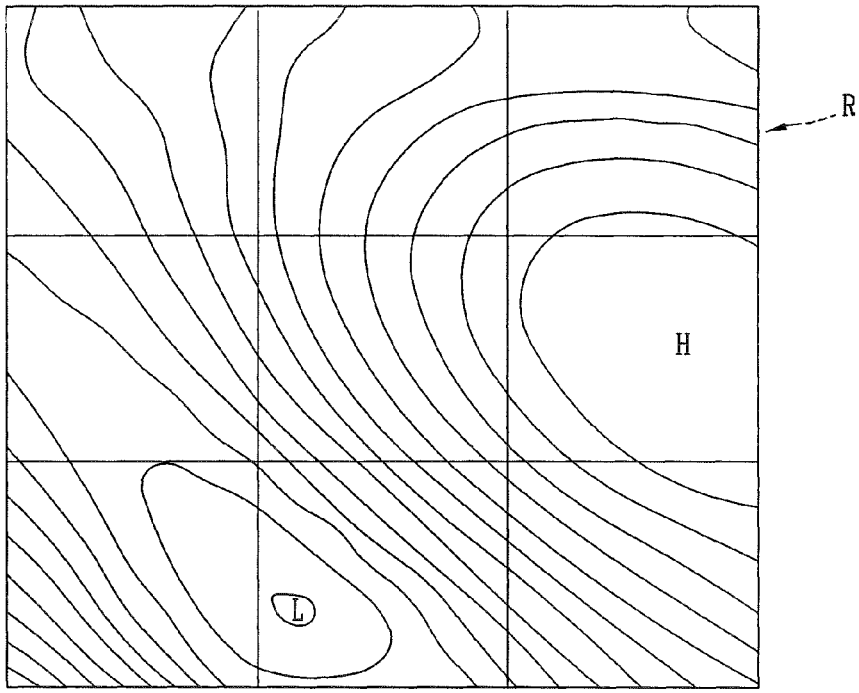
FIGS. 12A and 12B show distributions of electric fields before and after the second conductor of FIG. 10 is applied to the second antenna.
Figure 12B:
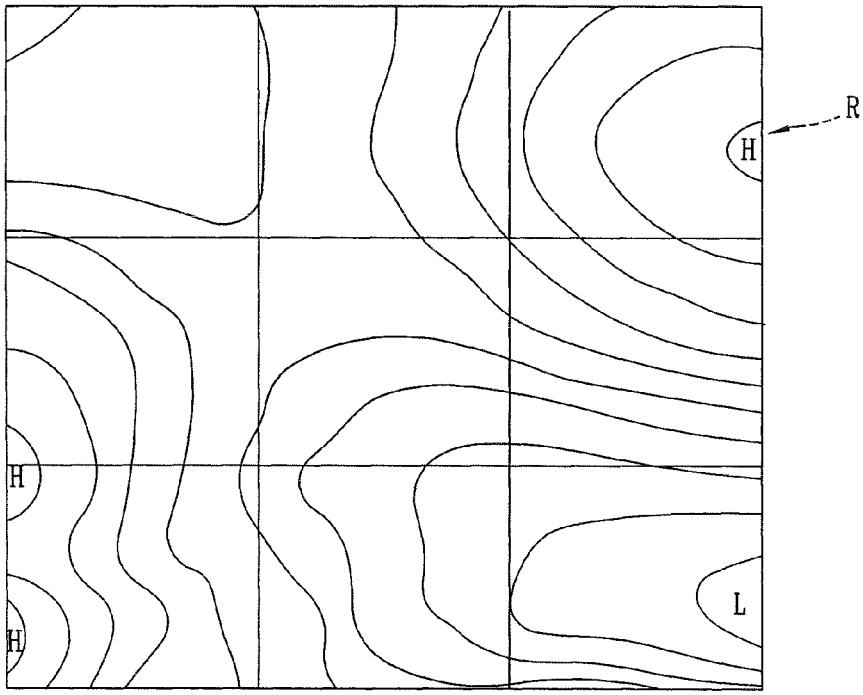

FIGS. 12A and 12B show distributions of electric fields before and after the second conductor of FIG. 10 is applied to the second antenna. FIGS. 12A and 12B show distributions of an electric field formed by an electromagnetic wave of PCS 1900 Mhz band.

Referring to FIG. 12A, before the second conductor 362 is applied to the second antenna 360, a high electric field is distributed to the right side of the measuring region (R), i.e., regions of 7~9. This is because the radiating region of an electromagnetic wave of PCS 1900 Mhz band is formed at the right side of the terminal body.

Referring to FIG. 12B, when the second conductor 362 is applied to the second antenna 360, a high electric field having been distributed to the right side of the measuring region (R), i.e., regions of 7~9 is weakened. That is, it can be seen that the high electric field of FIG. 12 is shifted to the right side as the second conductor 362 is applied to the second antenna 360.

By corresponding the radiating region (A) of the first antenna 350 to the position of the second conductor 362 of the second antenna 360, the field strength of the measuring region (R) can be reduced.

Figure 13:
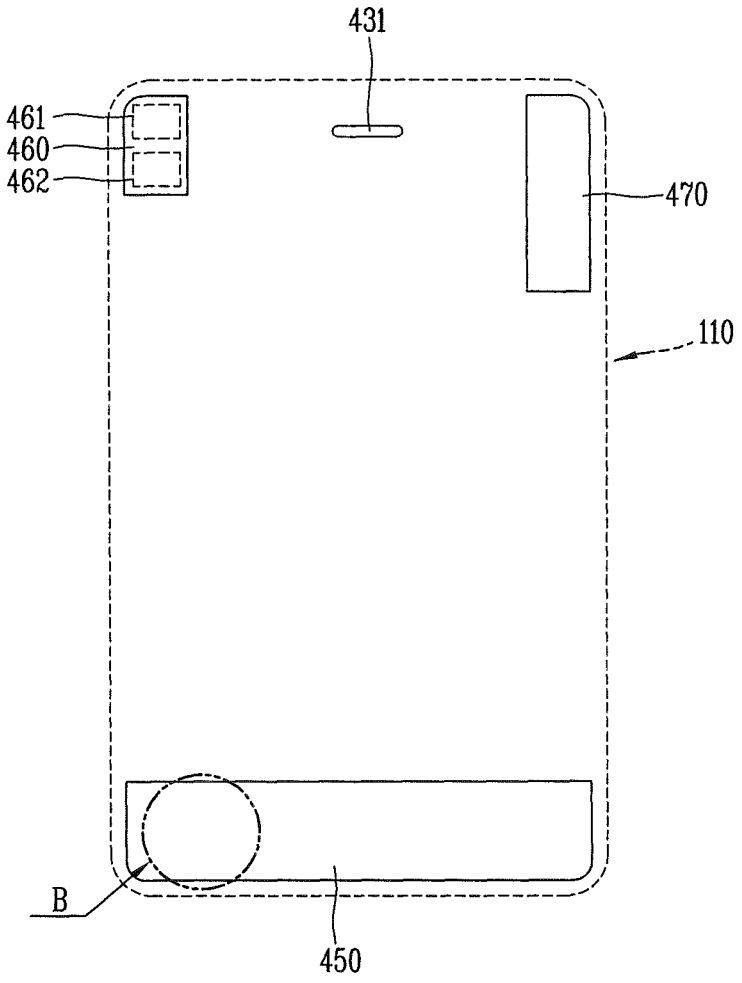
FIG. 13 is a schematic front view of a portable terminal according to a fourth embodiment of the present invention.
Figure 14:
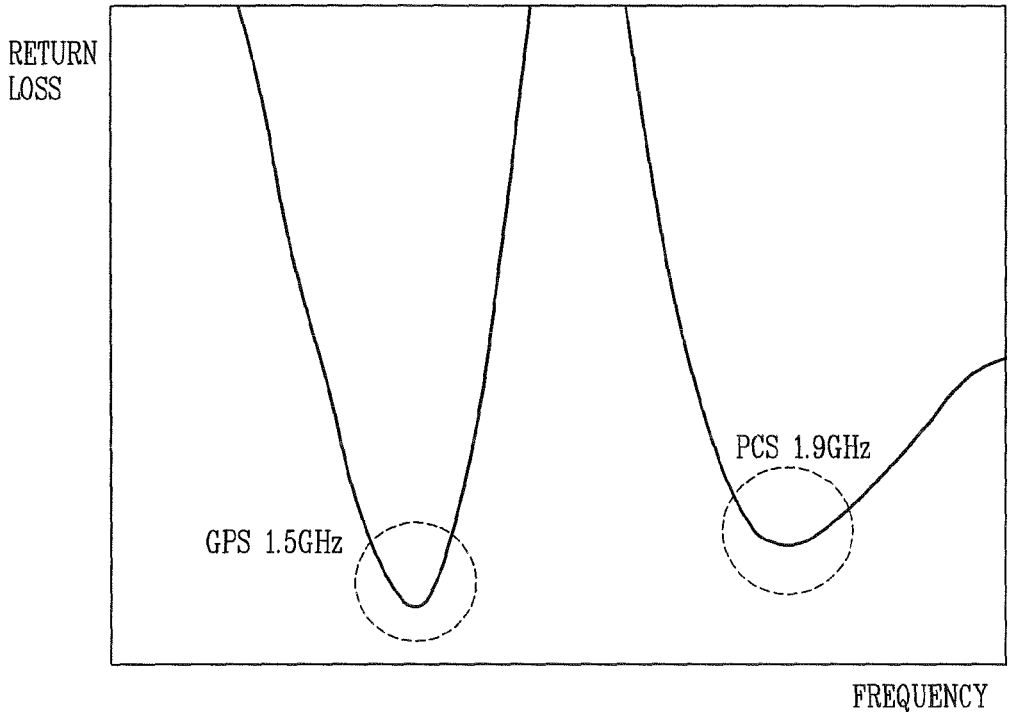
FIG. 14 is a graph showing a VSWR of a second antenna of FIG. 13.

FIG. 13 is a schematic front view of a portable terminal according to a fourth embodiment of the present invention, and FIG. 14 is a graph showing a voltage standing wave ratio (VSWR) of a second antenna of FIG. 13. The same or similar reference numerals as/to those of the aforementioned embodiments are given to the same or similar components as/to those of the aforementioned embodiments.

In the fourth embodiment, a radiating region (B) is formed at the left side of a first antenna 450. More concretely, the radiating region (B) is formed at the left side based on a central region of a terminal body 410.

In this case, a second antenna 460 having a second conductor 462 may be disposed at the left side based on the central region of the terminal body 410.

In the fourth embodiment, the first antenna 450 is implemented as a main antenna operable at four bands of GSM 850 Mhz, GSM 900 Mhz, DCS 1800 Mhz, and PCS 1900 Mhz. Like in the aforementioned embodiments, the first band is PCS 1900 Mhz band.

The second antenna 460 is implemented as a GPS antenna operable at GPS 1500 Mhz band (second band), and a third antenna 470 is implemented as a BLUETOOTH antenna operable at BLUETOOTH 2400 Mhz (third band).

Contrary to the aforementioned embodiments, the radiating region (B) according to the fourth embodiment is formed at the left side of the terminal body. Accordingly, the second antenna 460 is disposed at the left side of a receiver 431 in correspondence to the radiating region (B). Here, a first conductor 461 and a is second conductor 462 may be formed on a rear surface of the second antenna 460.

In the fourth embodiment, both the second antenna 460 and the third antenna 470 are applied. However, the second antenna 460 may be exclusively applied without using the third antenna 470.

Referring to FIG. 14, the second antenna 460 may be configured to further resonate at PCS 1900 Mhz band (first band), as well as at GPS 1500 Mhz (second band).

Figure 15A:
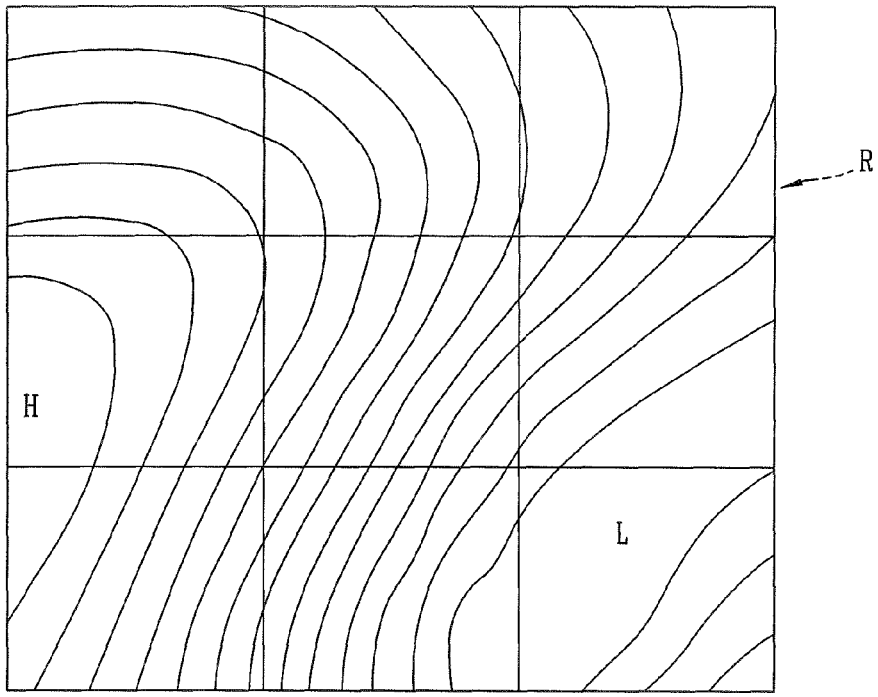
FIGS. 15A and 15B show distributions of electric fields before and after a second conductor of FIG. 13 is applied to the second antenna.
Figure 15B:
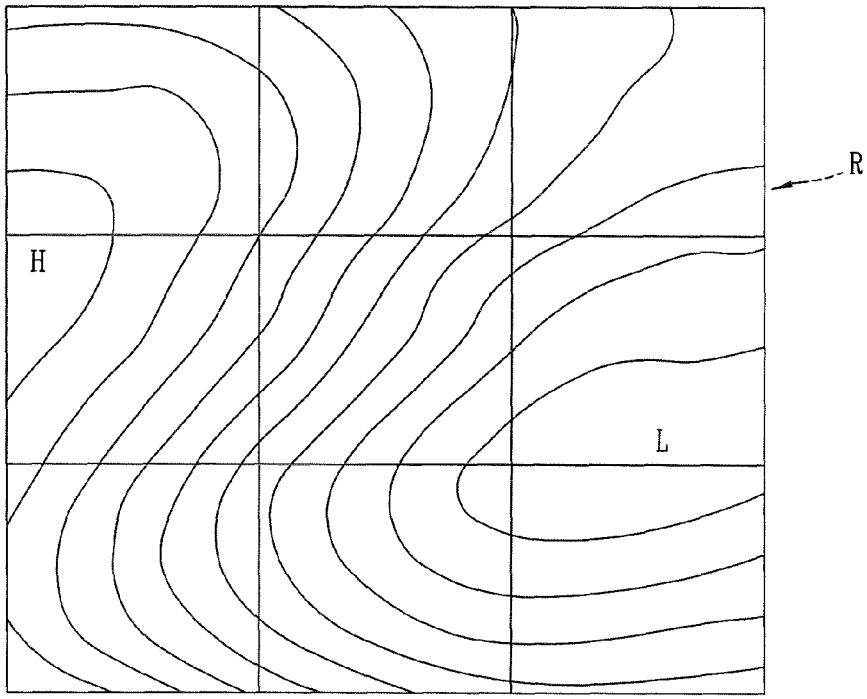

FIGS. 15A and 15B show distributions of electric fields before and after the second conductor is applied to the second antenna. FIGS. 15A and 15B show distributions of an electric field formed by an electromagnetic wave of PCS 1900 Mhz band.

Referring to FIG. 15A, before the second conductor 462 is applied to the second antenna 460, a high electric field is distributed to the left side of the measuring region (R), i.e., regions of 1~3. This is because the radiating region (B) of an electromagnetic wave of PCS 1900 Mhz band is formed at the left side of the terminal body 410 contrary to the aforementioned embodiments.

Referring to FIG. 15B, when the second conductor 462 is applied to the second antenna 460, a high electric field having been distributed to the left side of the measuring region (R), i.e., regions of 1~3 is weakened. That is, it can be seen that the high electric field of FIG. 15 is shifted to the left side as the second conductor 462 is applied to the second antenna 460.

By corresponding the radiating region (B) of the first antenna 450 to the position of the second conductor 462 of the second antenna 460, the field strength of the measuring region (R) can be reduced.

In the third and fourth embodiments, in a case that sub antennas are mounted to a plurality of positions of the terminal bodies 310, 410, the second conductor is formed at the sub antenna corresponding to each of the radiating regions (A, B). This may reduce a field strength of an electromagnetic wave of the first band distributed to the measuring region.

Figure 16:
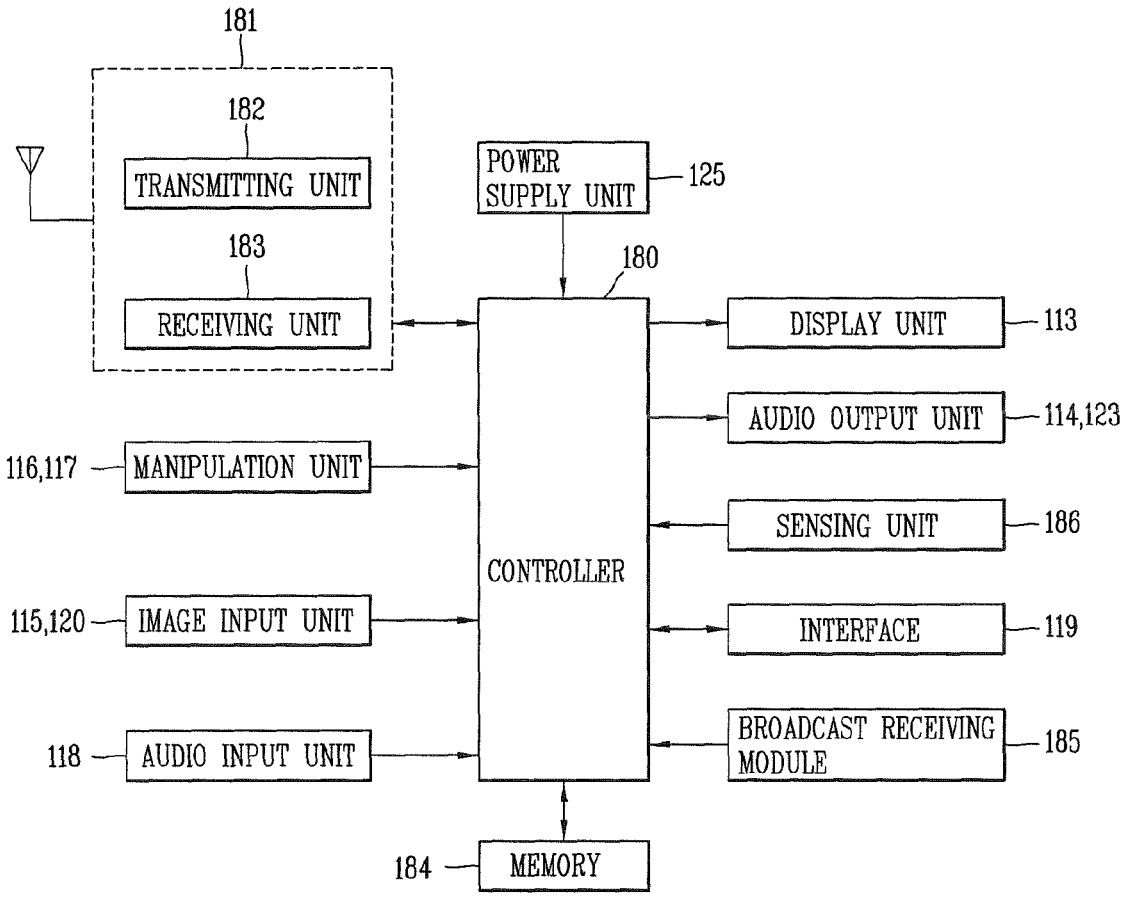
FIG. 16 is a block diagram of the portable terminal according to the present invention.

FIG. 16 is a block diagram showing the portable terminal 100 according to the present invention.

Referring to FIG. 16, the portable terminal 100 according to the first embodiment of the present invention comprises a wireless communication module 181, first and second manipulation units 116 and 117, first and second image input units 115, 120, an audio input unit 118, a display unit 113, audio output units 114, 123, a sensing unit 186, an interface 119, a broadcast receiving module 185, a memory 184, a power supply unit 125, and a controller 180.

The controller 180 controls an entire operation of the portable terminal. For instance, the controller 180 performs controls and processes relating to voice communication, data communication, video communication, and the like.

The wireless communication module 181 transmits/receives wireless signals to/from a base station through an antenna. For instance, the wireless communication module 181 transmits/receives voice data, text data, image data, and control data under control of the controller 180. The wireless communication module 181 includes a transmitting unit 183 for transmitting signals after a modulation process, and a receiving unit 182 for demodulating received signals.

The first and second manipulation units 116 and 117 provide, to the controller 180, key input data input by a user so as to control the operation of the portable terminal 100.

The first and second image input units 115, 120 process image frames such as still images or moving images captured by an image sensor in a video-call mode or a capturing mode. Then, the processed image frames are converted to image data that can be displayed on the display unit 113, thereby being output to the display unit 113.

Image frames processed by the first and second image input units 115, 120 are stored in the memory 184 under control of the controller 180, or are transmitted to outside through the wireless communication module 181.

The audio input unit 118 receives an external audio signal through a microphone in a call mode, or a recording mode, or a voice recognition mode, and the like, and then processes the received signal into electric voice data. In the case of a call mode, the processed voice data is converted into data that can be transmitted to the base station through the wireless communication module 181, and then is output to the wireless communication module 181. In the case of a recording mode, the processed voice data is output so as to be stored in the memory 184.

The audio input unit 118 may include assorted noise removing algorithms to remove noise generated in the course of receiving the external audio signal.

The display unit 113 may output information processed in the portable terminal. For example, when the portable terminal operates in a phone call mode, the display unit 113 will provide a User Interface (UI) or a Graphic User Interface (GUI) which includes information associated with the call. As another example, if the portable terminal is in a video call mode or a capturing mode, the display unit 113 may display captured images, or UI or GUI under control of the controller 180.

In a call mode or a recording mode, a voice recognition mode, a broadcasting signal reception mode, and the like, the first and second audio output units 114, 123 convert audio data received from the wireless communication module 181, or audio data stored in the memory 184, under control of the controller 180. Then, the audio output units 114, 123 output the converted data to outside.

The audio output units 114, 123 output audio signals relating to functions performed in the portable terminal, such as sound indicating a call signal reception, or sound indicating a message reception. These audio output units 114, 123 include a speaker, a receiver, a buzzer, etc.

The sensing unit 186 senses a current status of the portable terminal such as an open/close status of the portable terminal, a position of the portable terminal, or whether a user has contacted the portable terminal, thereby generating sensing signals to control the operation of the portable terminal. For instance, the sensing unit 186 performs sensing functions relating to whether power has been supplied from the power supply unit 125, or whether the interface 119 has been coupled to an external device, and the like.

The interface 119 interfaces a wire/wireless headset, an external charger, a wire/wireless data port, a card socket (e.g., memory card, SIM/UIM card), and the like, with any types of external devices connected to the portable terminal. The interface 119 transmits data or power received from external devices, to each component in the portable terminal, or transmits data in the portable terminal to the external devices.

The memory 184 may store programs to be processed and controlled by the controller 180, or may temporarily store input/output data (e.g., phonebook, messages, still images, moving images, etc.).

The memory 184 may store programs to control the operation of the portable terminal according to the present invention.

The memory 184 may be implemented using any type of suitable storage medium including a flash memory type, a hard disk type, a multimedia card micro type, a memory card type (e.g., SD or DX memory), Random Access Memory (RAM), Read-Only Memory (ROM), and the like.

The broadcast receiving module 185 receives broadcasting signals transmitted through satellite or terrestrial wave, and then converts them to broadcasting data that can be output to the audio output units 114, 123 and the display unit 113, thereby outputting the broadcasting data to the controller 180. The broadcast receiving module 185 receives broadcasting-related additional data (e.g., Electric Program Guide: EPG, channel list, and the like). Broadcasting data and additional data converted by the broadcast receiving module 185 may be stored in the memory 184.

The power supply unit 125 receives inner or outer power, and supplies the power to each component of the portable terminal under control of the controller 180.

As aforementioned, the second conductor having a physical condition to resonate an electromagnetic wave of the first band is formed at the second antenna disposed at a different position from the first antenna operating at the first band. This may reduce a field strength of an electromagnetic wave of the first band near the receiver. Accordingly, interference between the portable terminal and any hearing aid may be minimized.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal, comprising:

a terminal body having a receiver for sound output;

a first antenna disposed in the terminal body, and operating at a first band;

a second antenna disposed at a position different from the first antenna, and operating at a second band, wherein the second antenna comprises:

a first conductor having a physical characteristic configured to resonate an electromagnetic wave of the second band; and a second conductor wirelessly coupled to the first antenna and having a physical characteristic configured to resonate an electromagnetic wave of the first band so as to reduce a field strength of the first band near the receiver.

2. The portable terminal of claim 1, wherein the receiver is disposed at one end of the terminal body, and the first antenna is disposed at another end of the terminal body.

3. The portable terminal of claim 2, wherein the second antenna is disposed at one end of the terminal body.

4. The portable terminal of claim 1, wherein the second antenna is extending from the first antenna in one direction.

5. The portable terminal of claim 4, wherein the first antenna comprises a radiator formed of a conductive material, and a carrier configured to support the radiator, and wherein the first and second conductors are disposed on an extension portion extending from the carrier.

6. The portable terminal of claim 1, wherein the second antenna is disposed at a position spacing from the first antenna by a predetermined distance in a length direction of the terminal body.

7. The portable terminal of claim 6, wherein the second antenna is disposed between the receiver and the first antenna.

8. The portable terminal of claim 1, wherein the second antenna further comprises a feeding portion and a grounding portion.

9. The portable terminal of claim 8, wherein the feeding portion and the grounding portion are extending from one of the first and second conductors.

10. The portable terminal of claim 9, wherein the feeding portion and the grounding portion are extending from another of the first and second conductors.

11. The portable terminal of claim 9, wherein the second conductor is extending from the feeding portion.

12. The portable terminal of claim 1, wherein the first antenna is configured to be operable at a plurality of bands, and wherein the first band indicates a band which forms a highest field strength near the receiver among the plurality of bands.

13. The portable terminal of claim 12, wherein a radiating region for radiating an electromagnetic wave of the first band is formed at a part of the first antenna, and wherein the second antenna is disposed at a position corresponding to the radiating region in a width direction of the terminal body.

14. The portable terminal of claim 13, whereat the first band comprises two or more bands among GSM/WCDMA 850 Mhz, GSM/WCDMA 900 Mhz, DCS/GSM 1800 Mhz, PCS/GSM 1900 Mhz, and WCDMA 2100 Mhz, and whereat the second band of the second antenna comprises at least one of a Bluetooth band and a GPS band.

15. The portable terminal of claim 1, wherein the second antenna is disposed at one side of the receiver.

16. The portable terminal of claim 15, further comprising a third antenna disposed at another side of the receiver and operating at a third band.

17. The portable terminal of claim 16, whereat the first band comprises one of GSM/WCDMA 850 Mhz, GSM/WCDMA 900 Mhz, DCS/GSM 1800 Mhz, PCS/GSM 1900 Mhz, and WCDMA 2100 Mhz band, wherein the second band comprises one of a Bluetooth band and a GPS band, and wherein the third band comprises another of the Bluetooth band and the GPS band.

18. A portable terminal, comprising:

a terminal body having a receiver for sound output;

a first antenna disposed in the terminal body, and operating at a first band;

a second antenna disposed at a position different from the first antenna, and operating at a second band, wherein the second antenna comprises:

a first conductor having a physical condition operable at the second band; and a second conductor having a physical condition to resonate an electromagnetic wave of the first band so as to reduce a field strength of the first band near the receiver, wherein the second antenna is extending from the first antenna in one direction, wherein the first antenna comprises a radiator formed of a conductive material, a carrier configured to support the radiator, and wherein the first and second conductors are disposed on an extension portion extending from the carrier.

19. A portable terminal, comprising:

a terminal body;

a first antenna disposed in the terminal body and operating at a first band; and a second antenna disposed at a position different from the first antenna and operating at a second band, wherein the second antenna comprises:

a first conductor having a physical condition operable at the second band; and a second conductor configured to be wirelessly coupled to the first antenna, wherein the second antenna is extending from the first antenna in one direction, wherein the first antenna comprises a radiator formed of a conductive material and a carrier configured to support the radiator, and wherein the first and second conductors are disposed on an extension portion extending from the carrier.

* * * * *